US010480529B2

(12) United States Patent
Lin et al.

(10) Patent No.: US 10,480,529 B2
(45) Date of Patent: Nov. 19, 2019

(54) INDUCED DRAFT FAN AND GAS FURNACE COMPRISING THE SAME

(71) Applicant: Zhongshan Broad-Ocean Motor Co., Ltd., Zhongshan (CN)

(72) Inventors: Yanhu Lin, Zhongshan (CN); Wei Lei, Zhongshan (CN); Fengqi Wang, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 174 days.

(21) Appl. No.: 15/826,598

(22) Filed: Nov. 29, 2017

(65) Prior Publication Data

US 2019/0085863 A1 Mar. 21, 2019

(30) Foreign Application Priority Data

Sep. 20, 2017 (CN) ..... 2017 2 1209371 U

(51) Int. Cl.

| | |
|---|---|
| ***F04D 29/44*** | (2006.01) |
| ***F04D 29/42*** | (2006.01) |
| ***F04D 13/06*** | (2006.01) |
| ***F24H 9/16*** | (2006.01) |
| ***F24H 9/00*** | (2006.01) |
| ***F24H 3/06*** | (2006.01) |
| ***F04D 17/16*** | (2006.01) |
| ***F04D 29/70*** | (2006.01) |

(52) U.S. Cl.

CPC ..... *F04D 29/4233* (2013.01); *F04D 13/06* (2013.01); *F04D 17/16* (2013.01); *F04D 29/422* (2013.01); *F04D 29/4226* (2013.01); *F04D 29/706* (2013.01); *F24H 3/065* (2013.01); *F24H 9/0073* (2013.01); *F24H 9/16* (2013.01); *F05D 2260/602* (2013.01)

(58) Field of Classification Search

CPC ..... F04D 29/4226; F04D 29/4233; F24H 9/0073; F24H 9/16; F05D 2260/602

See application file for complete search history.

(56) References Cited

U.S. PATENT DOCUMENTS

| | | | | |
|---|---|---|---|---|
| 5,547,232 A * | 8/1996 | Waterman | F16L 21/00 | 285/236 |
| 6,511,290 B1 * | 1/2003 | Gatley, Jr. | F04D 29/4226 | 285/322 |
| 6,536,378 B2 * | 3/2003 | Lyons | F01B 31/18 | 122/20 B |
| 7,354,244 B2 * | 4/2008 | Hasbargen | F23L 17/005 | 415/212.1 |

* cited by examiner

*Primary Examiner* — Ninh H. Nguyen

(74) *Attorney, Agent, or Firm* — Matthias Scholl P.C.; Matthias Scholl

(57) ABSTRACT

An induced draft fan, including a volute including a chamber and an air discharge pipe; and a wind wheel disposed in the chamber of the volute. The wind wheel is connected to and operationally driven by a rotation shaft of a motor. The air discharge pipe is disposed on one side of the volute, and includes an inner pipe and an outer pipe surrounding the inner pipe. The inner pipe of the air discharge pipe communicates with the chamber, to form an air discharge passage. An annular groove is disposed between the inner pipe and the outer pipe; and the outer end of the outer pipe is provided with a curved groove, the curved groove extends axially and circumferentially to divide the outer pipe into a fixed part and a flexible part.

20 Claims, 14 Drawing Sheets

INDUCED DRAFT FAN AND GAS FURNACE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 201721209371.6 filed Sep. 20, 2017, the contents of which and any intervening amendments thereto are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The present disclosure relates to an induced draft fan and a gas furnace comprising the same.

Description of the Related Art

Conventional induced draft fans may include a volute and an air discharge pipe including an inner pipe, an outer pipe, and an annular groove disposed between the inner pipe and the outer pipe. To change the air discharge direction, a conversion interface is mounted on the air discharge pipe, and a seal ring is disposed between the conversion interface and the outer pipe. However, this arrangement is laborious and inefficient.

SUMMARY OF THE INVENTION

It is one objective of the present disclosure to provide an induced draft fan and a gas furnace comprising the same. In the present disclosure, it is advantageous to assemble the conversion interface and the seal ring in the annular groove, thus improving the assembly efficiency of the induced draft fan.

To achieve the above objective, in accordance with one embodiment of the present disclosure, there is provided an induced draft fan, comprising a volute comprising a chamber and an air discharge pipe; and a wind wheel disposed in the chamber of the volute. The wind wheel is connected to and operationally driven by a rotation shaft of a motor; the air discharge pipe is disposed on one side of the volute, and comprises an inner pipe and an outer pipe surrounding the inner pipe; the inner pipe of the air discharge pipe communicates with the chamber, to form an air discharge passage; an annular groove is disposed between the inner pipe and the outer pipe; and an outer end of the outer pipe is provided with a curved groove, the curved groove extends axially and circumferentially to divide the outer pipe into a fixed part and a flexible part.

In a class of this embodiment, a first flange and a second flange protrude circumferentially from the outer end of the outer pipe, the first flange is located on an end face of the outer pipe, a locating slot is disposed between the first flange and the second flange, and the curved groove is located in the locating slot.

In a class of this embodiment, the curved groove is arc-shaped or L-shaped.

In a class of this embodiment, the curved groove is L-shaped and comprises an axial part and a circumferential part, and the circumferential part is close to one side of the second flange.

In a class of this embodiment, the curved groove is L-shaped and comprises an axial part and a circumferential part; the fixed part comprises a lower lug in the vicinity of the axial part, and the flexible part comprises an upper lug in the vicinity of the axial part and corresponding to the lower lug; the upper lug and the lower lug each comprise mounting through holes, each mounting through hole comprises a bolt and a nut is provided at a tail of the bolt, and the bolt and the nut cooperate to lock the fixed part and the flexible part.

In a class of this embodiment, the outer pipe comprises at least one drain hole at a bottom of the annular groove, and a drain pipe communicates with the at least one drain hole.

In a class of this embodiment, the outer pipe comprises two drain holes, and the drain pipe is tangent to the outer pipe.

In a class of this embodiment, a central angle formed by the axial part and the circumferential part of the curved groove is greater than or equal to 90 degrees and less than or equal to 270 degrees.

In accordance with another embodiment of the present disclosure, there is provided a gas furnace, comprising an induced draft fan and a conversion interface which is disposed on the air discharge pipe of the induced draft fan, wherein the conversion interface is embedded in the annular groove, a seal ring is disposed between the conversion interface and the outer pipe; the curved groove is located outside the seal ring, a hose clamp is disposed in the locating slot, a body of the hose clamp is located on the flexible part and the fixed part to close up the curved groove.

In accordance with still another embodiment of the present disclosure, there is provided a gas furnace, comprising an induced draft fan and a conversion interface which is disposed on the air discharge pipe of the induced draft fan, wherein the conversion interface is embedded in the annular groove, a seal ring is disposed between the conversion interface and the outer pipe; the curved groove is located outside the seal ring, and the bolt and the nut cooperate to lock the fixed part and the flexible part, and close up the axial part.

Advantages of the induced draft fan and a gas furnace comprising the same of the present disclosure are summarized as follows:

1. In the induced draft fan of the present disclosure, the outer end of the outer pipe is provided with a curved groove, the curved groove extends axially and circumferentially to divide the outer pipe into a fixed part and a flexible part. The arrangement of the curved groove increases the range of motion of the flexible part along the circumferential direction, upon installing the conversion interface, the flexible part is slightly forced apart, the conversion interface and the seal ring are embedded in the annular groove, so that the installation of the conversion interface and the seal ring are simple and highly efficient.

2. A first flange and a second flange protrude circumferentially from the outer end of the outer pipe, the first flange is located on an end face of the outer pipe, and a locating slot is disposed between the first flange and the second flange. The arrangement of the locating slot standardizes the production.

3. The curved groove is L-shaped and comprises an axial part and a circumferential part, and the circumferential part is close to one side of the second flange, which is conducive to the installation of the conversion interface.

4. The fixed part comprises a lower lug, the flexible part comprises an upper lug corresponding to the lower lug, the lower lug and the upper lug are locked by the bolt and the nut, thus simplifying the structure, facilitating the assembly, and reducing the costs.

5. The outer pipe comprises at least one drain hole at a bottom of the annular groove, and a drain pipe communicates with the at least one drain hole, which is conducive to the drainage of the condensate water.

6. The installation of the conversion interface and the seal ring is easy and efficient, the fixed part and the flexible part are locked and fastened by the hose clamp or bolt/nut, thus reinforcing the sealing effect of the outer pipe, the seal ring and the conversion interface.

DETAILED DESCRIPTION OF THE EMBODIMENTS

Figure 1:
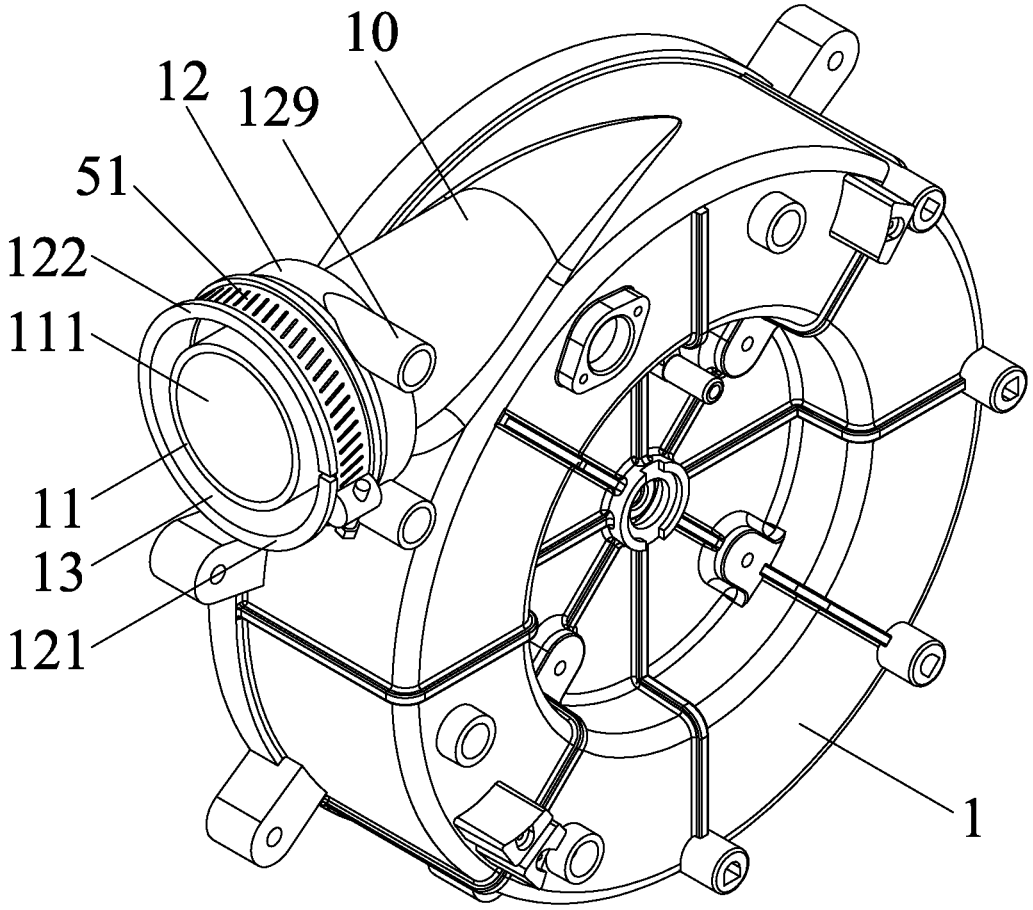
FIG. 1 is a schematic diagram of an induced draft fan in accordance with one embodiment of the present disclosure.
Figure 2:
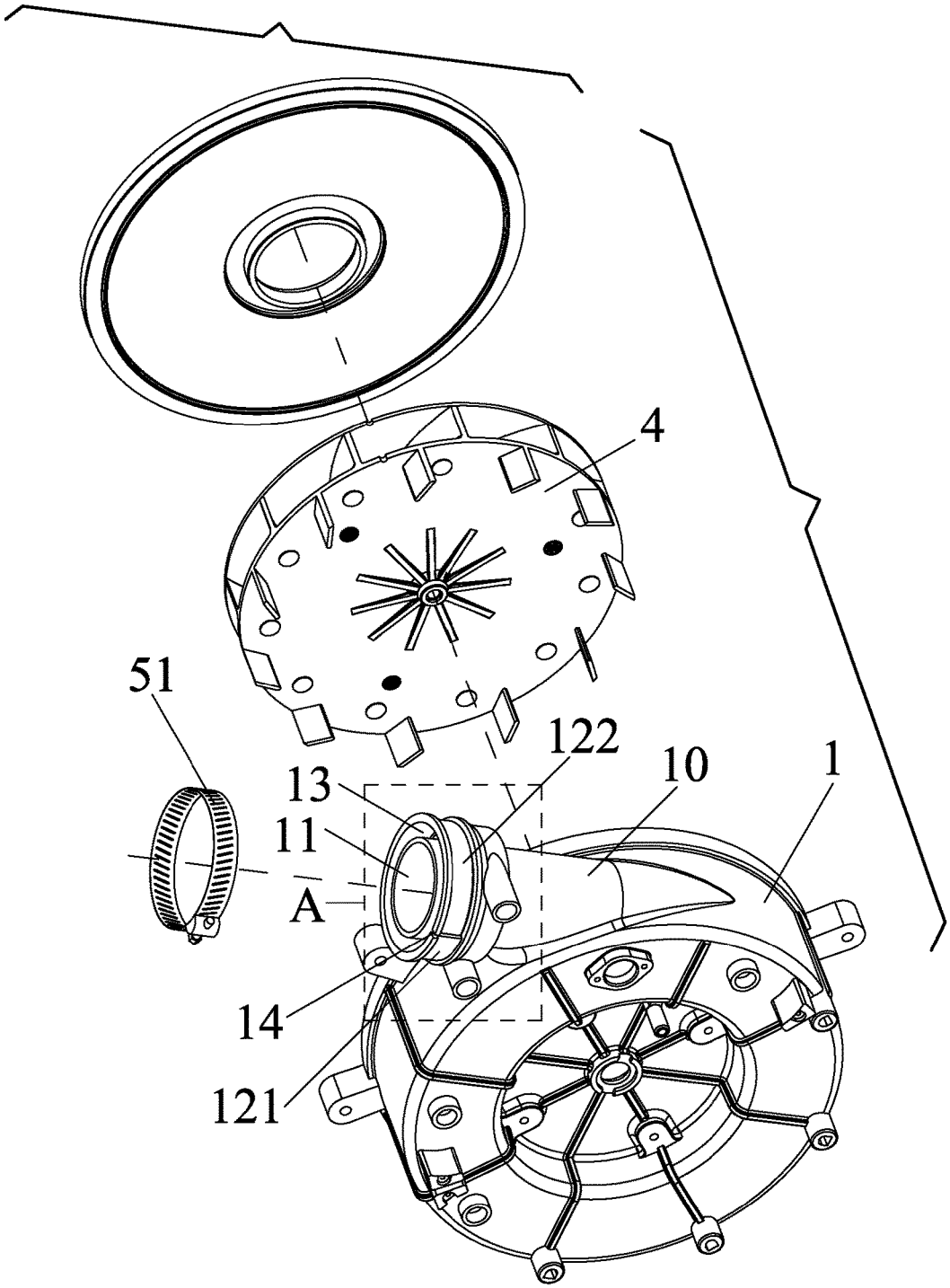
FIG. 2 is an exploded view of an induced draft fan.
Figure 3:
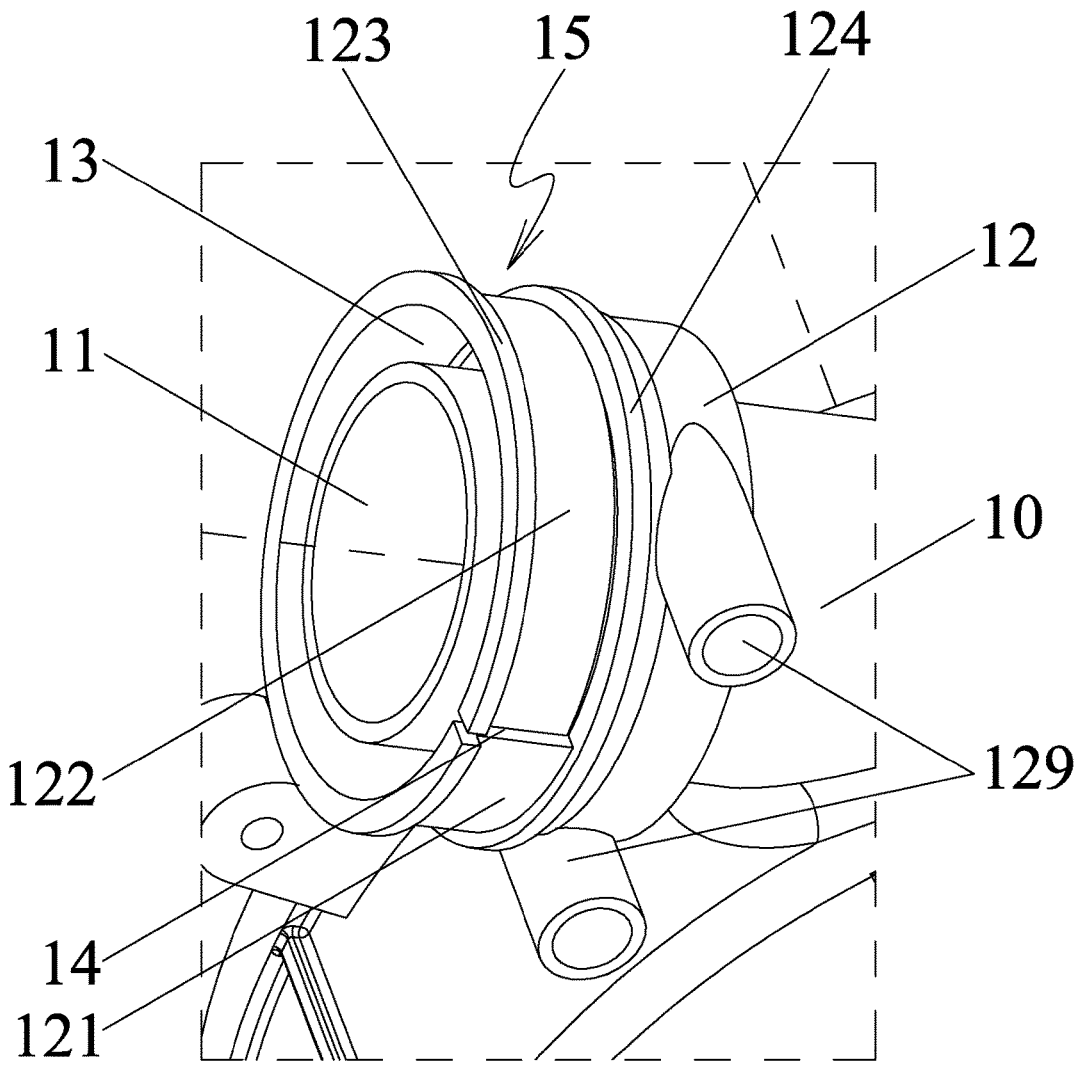
FIG. 3 is an enlarged view of part A in FIG. 2.
Figure 4:
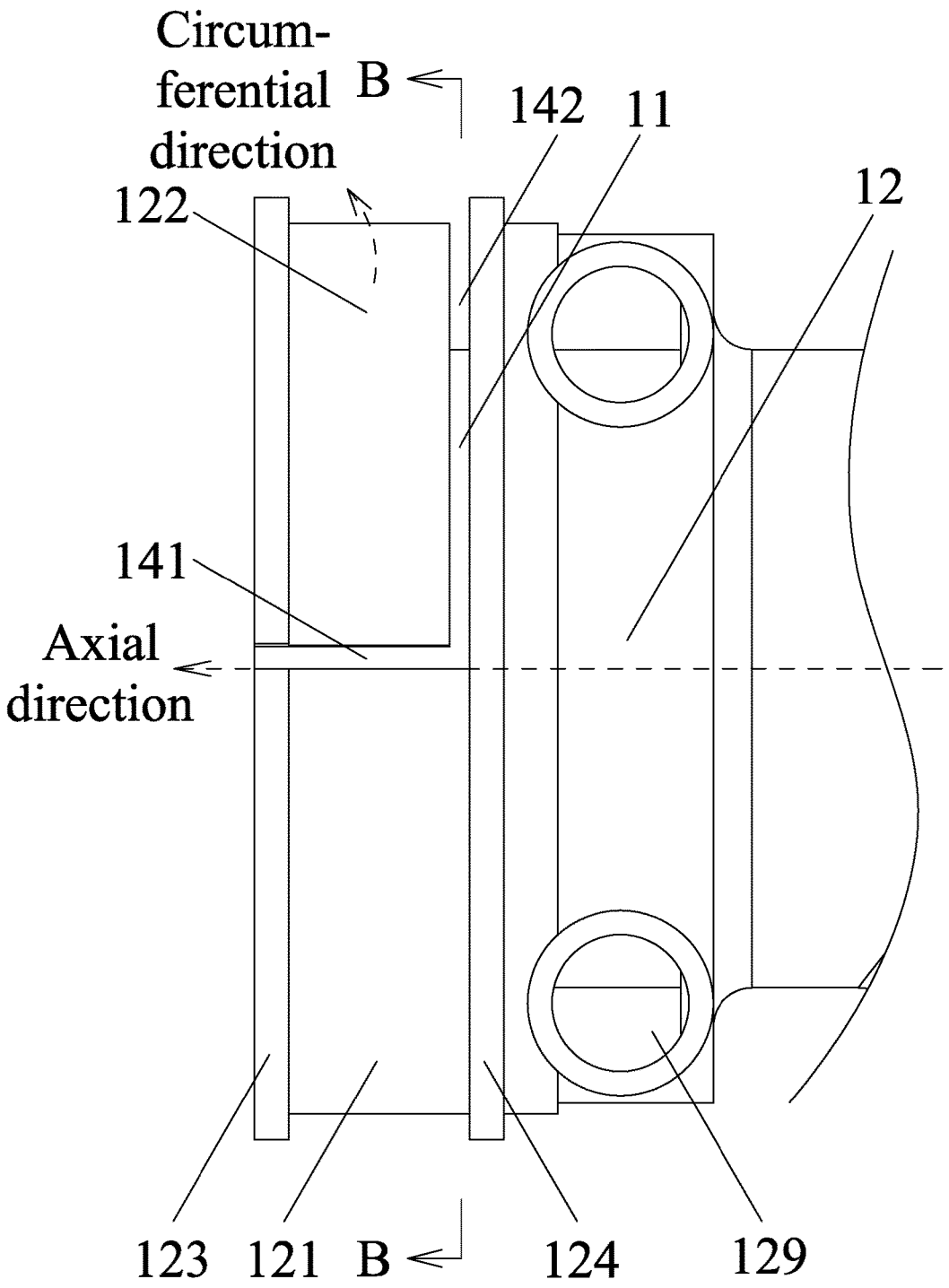
FIG. 4 is a front view of an air discharging pipe of an induced draft fan in accordance with one embodiment of the present disclosure.
Figure 5:
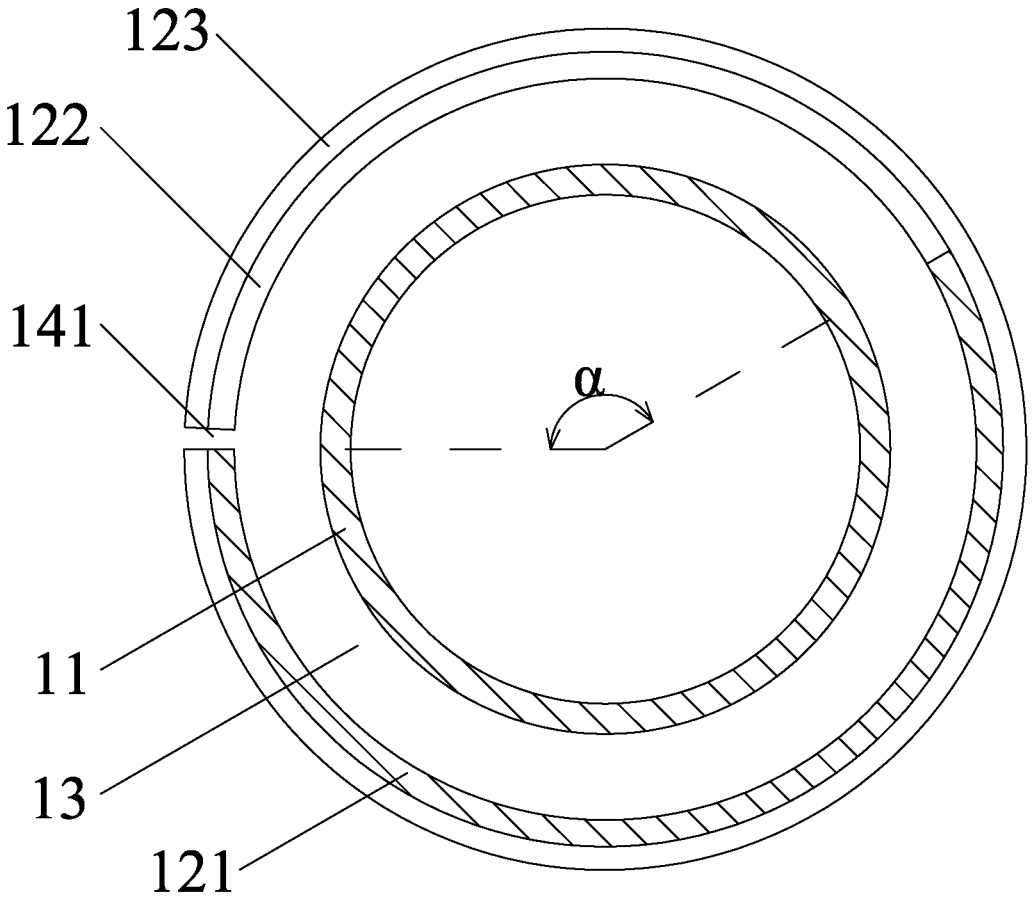
FIG. 5 is a sectional view of an air discharging pipe taken from line B-B in FIG. 4.
Figure 6:
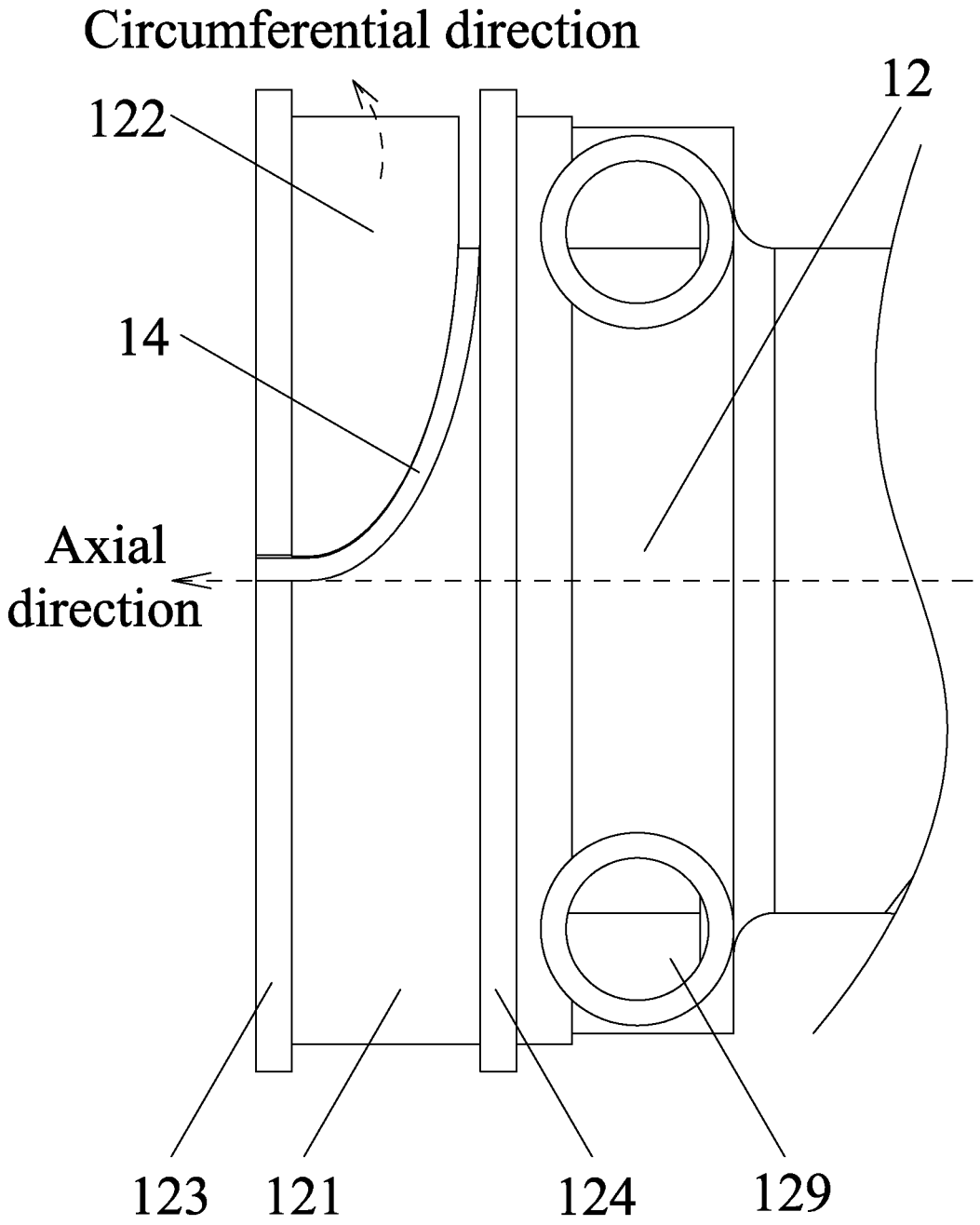
FIG. 6 is a front view of another air discharging pipe of an induced draft fan in accordance with one embodiment of the present disclosure.

For further illustrating the invention, experiments detailing an induced draft fan and a gas furnace comprising the same are described below. It should be noted that the following examples are intended to describe and not to limit the invention.

Example 1

As shown in FIGS. 1-6, an induced draft fan comprises a volute 1 comprising a chamber 19, and a wind wheel 4 disposed in the chamber 19 of the volute 1. The wind wheel 4 is connected to and operationally driven by a rotation shaft of a motor. The motor is disposed in or out of the volute. An air discharge pipe 10 is disposed on one side of the volute, and comprises an inner pipe 11 and an outer pipe 12 surrounding the inner pipe 11. The inner pipe 11 of the air discharge pipe communicates with the chamber 19, to form an air discharge passage 111 of the induced drat fan. An annular groove 13 is disposed between the inner pipe 11 and the outer pipe 12. An outer end of the outer pipe 12 is provided with a curved groove 14, the curved groove 14 extends axially and circumferentially to divide the outer pipe 12 into a fixed part 121 and a flexible part 122.

The arrangement of the curved groove 14 increases the range of motion of the flexible part 122 along the circumferential direction, upon installing the conversion interface 2, the flexible part 122 is slightly forced apart, the conversion interface 2 and the seal ring 3 are embedded in the annular groove, so that the installation of the conversion interface 2 and the seal ring 3 are simple and highly efficient.

A first flange 123 and a second flange 124 protrude circumferentially from the outer end of the outer pipe 12, the first flange 123 is located on an end face of the outer pipe 12, and a locating slot 15 is disposed between the first flange 123 and the second flange 124. The curved groove 14 is located in the locating slot 15. The arrangement of the locating slot 15 standardizes the production.

The curved groove 14 is L-shaped and comprises an axial part 141 and a circumferential part 142, and the circumferential part 142 is close to one side of the second flange 124, which is conducive to the assembly of the induced draft fan.

Optionally, the curved groove 14 is arc-shaped.

The outer pipe 12 comprises at least one drain hole 128 at the bottom of the annular groove 13, and a drain pipe 129 communicates with the at least one drain hole 128, which is conducive to the drainage of the condensate water.

The outer pipe comprises two drain holes 128, and the drain pipe 129 is tangent to the outer pipe 12.

The central angle formed by the axial part and the circumferential part of the curved groove 14 is greater than or equal to 90 degrees and less than or equal to 270 degrees.

The induced draft fan in the example has a reasonable structure.

Example 2

Figure 7:
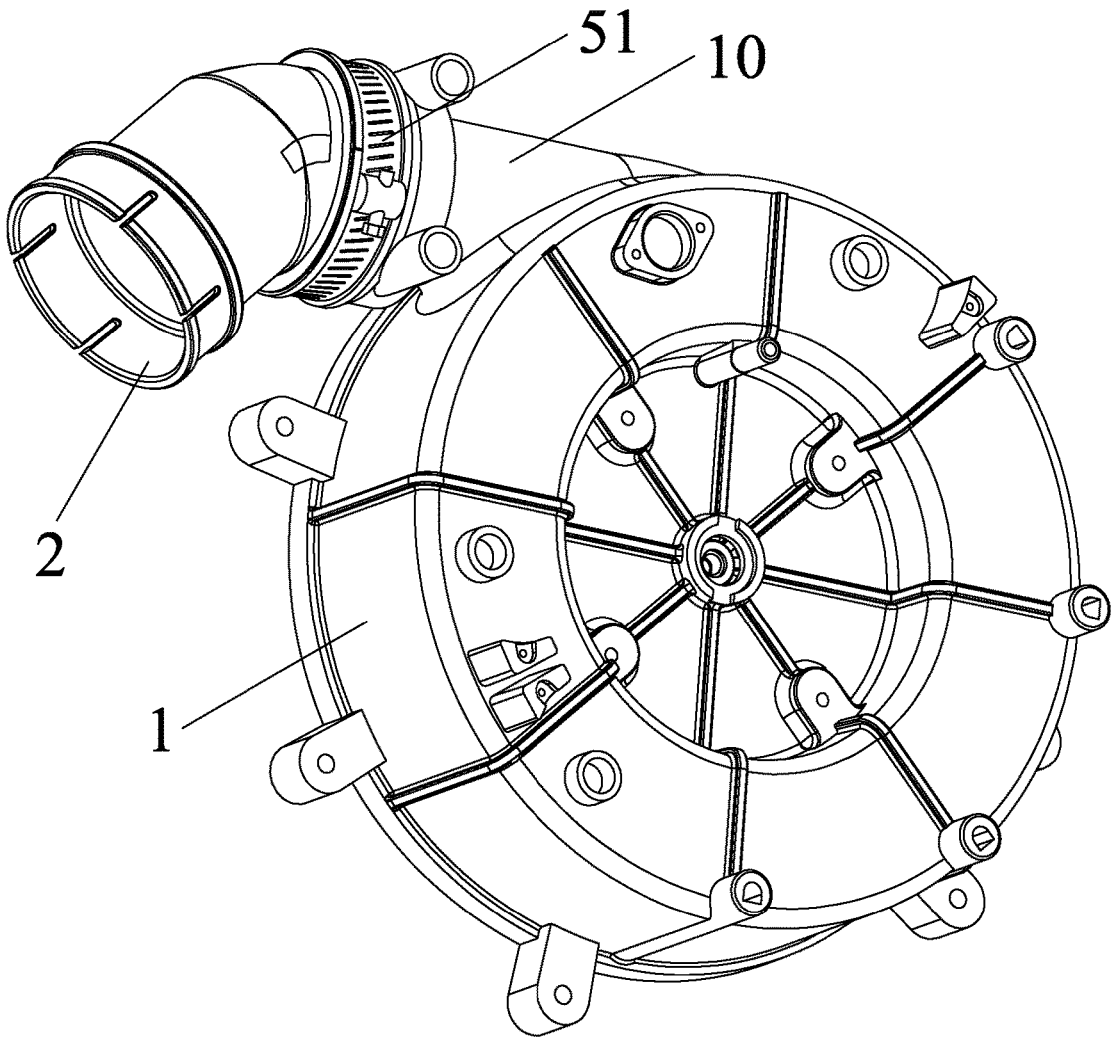
FIG. 7 is a schematic diagram of a gas furnace comprising an induced draft fan and a conversion interface in accordance with one embodiment of the present disclosure.
Figure 8:
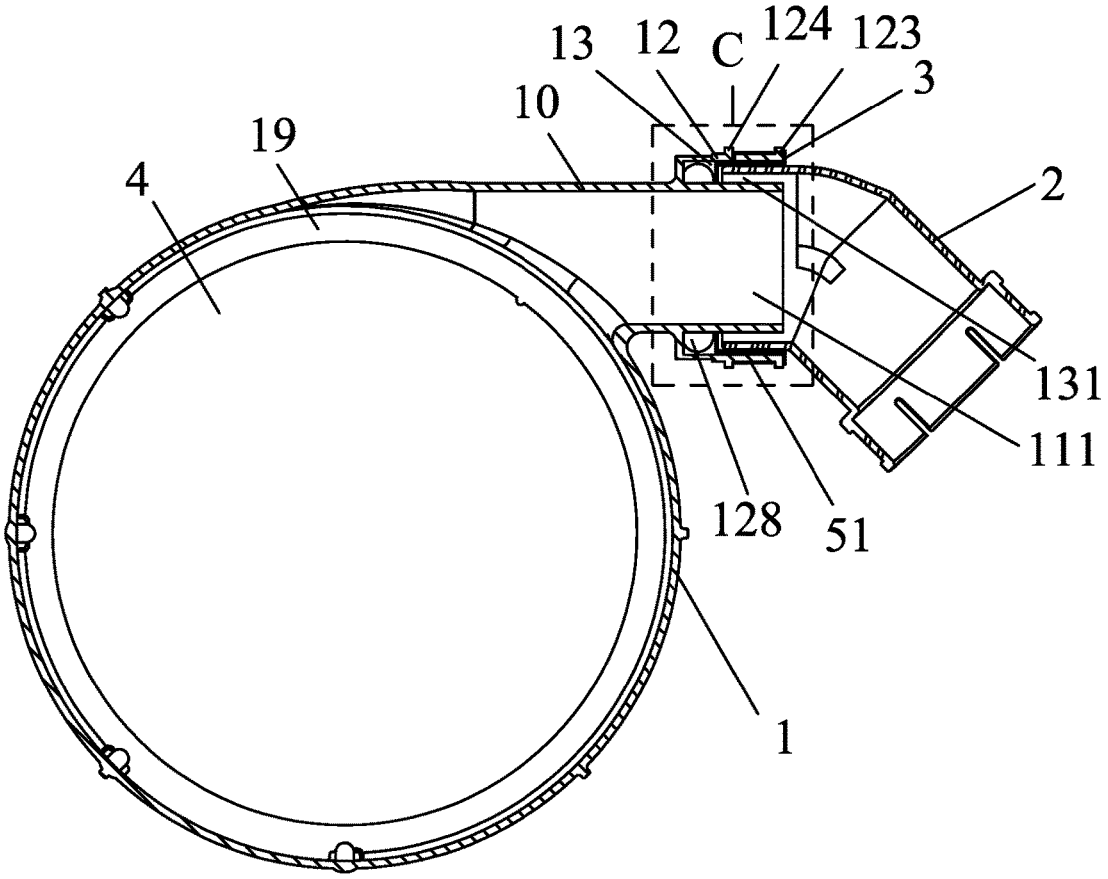
FIG. 8 is a sectional view of a gas furnace comprising an induced draft fan and a conversion interface in accordance with one embodiment of the present disclosure.
Figure 9:
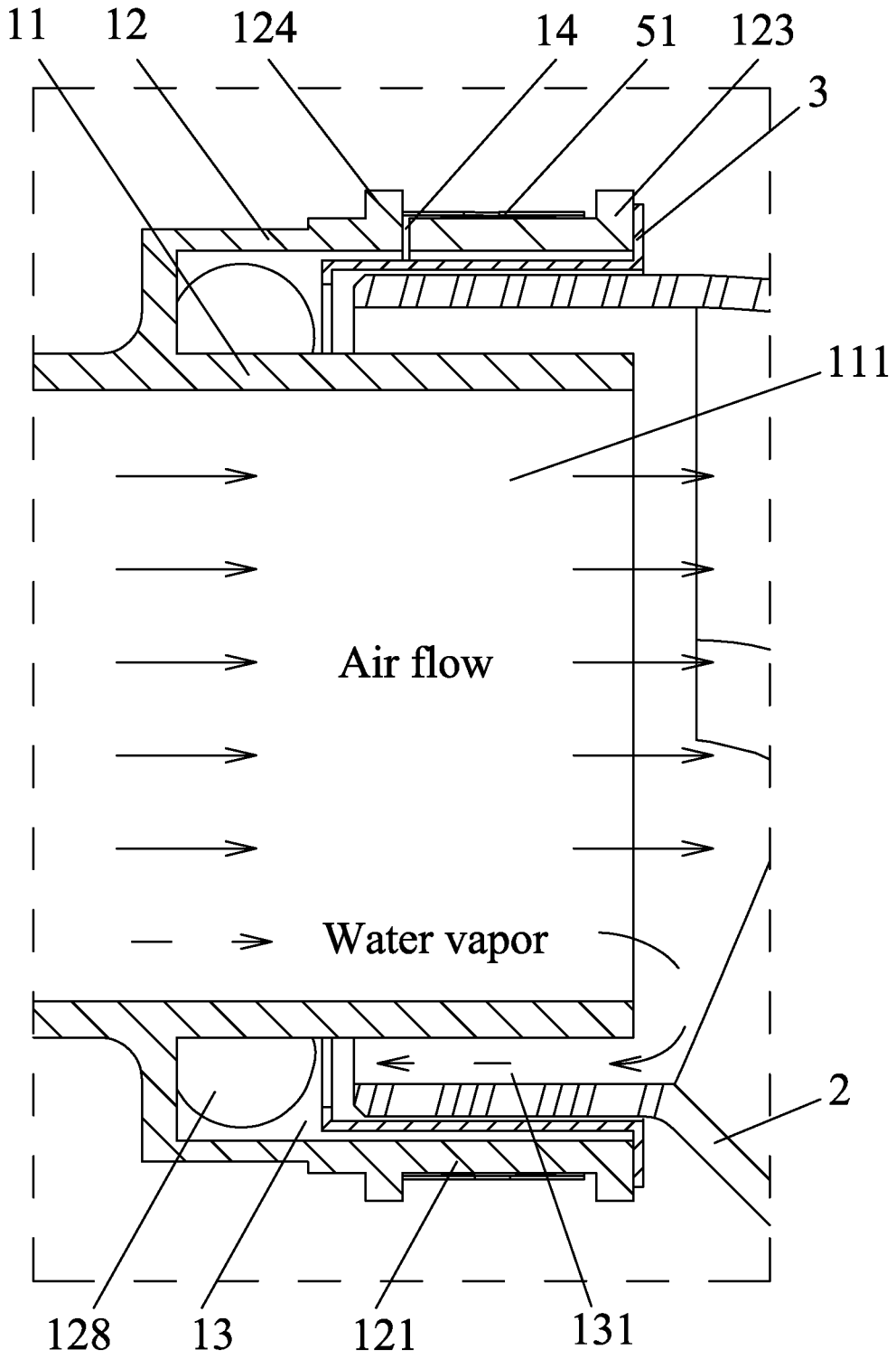
FIG. 9 is an enlarged view of part C in FIG. 8.
Figure 10:
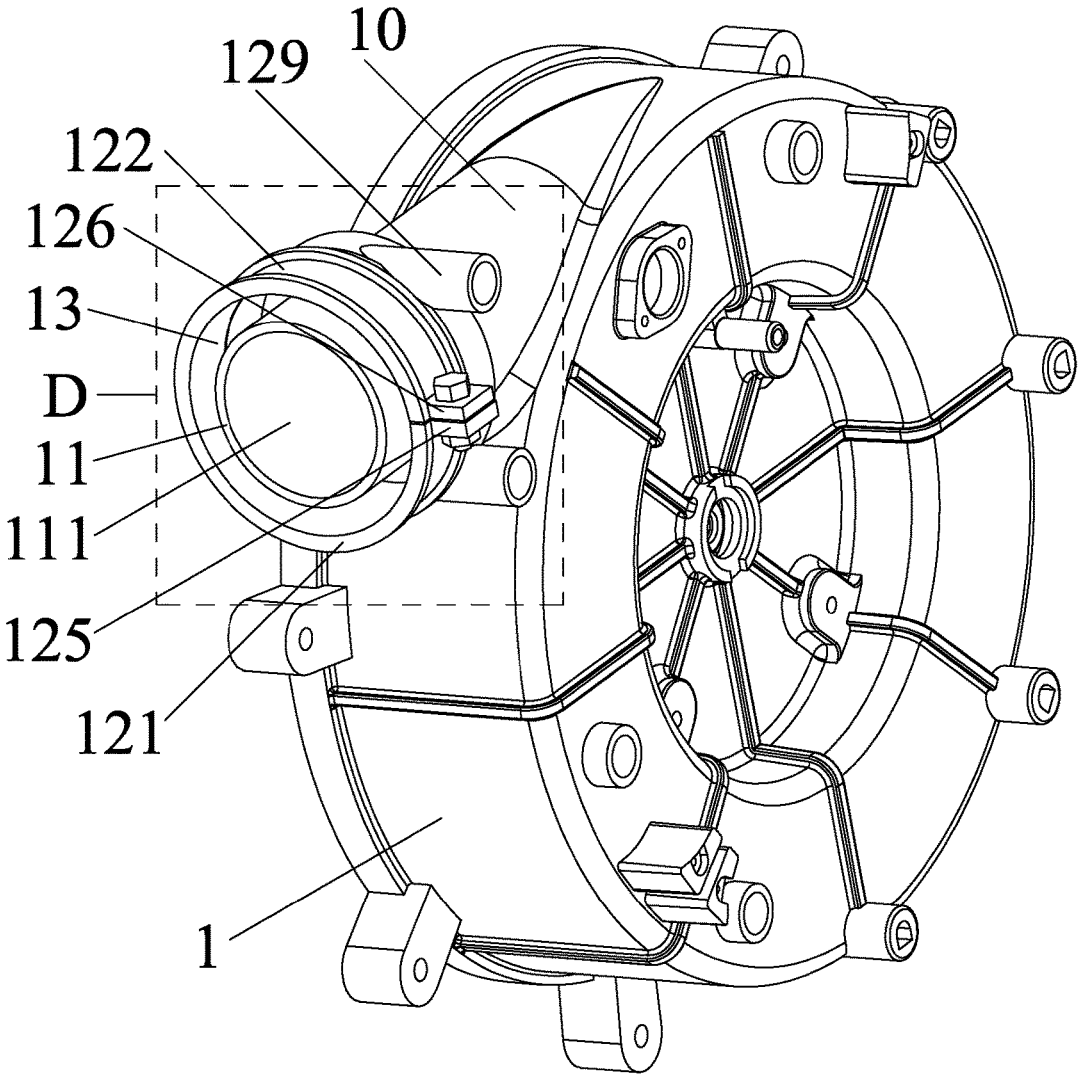
FIG. 10 is a schematic diagram of an induced draft fan in accordance with another embodiment of the present disclosure.
Figure 11:
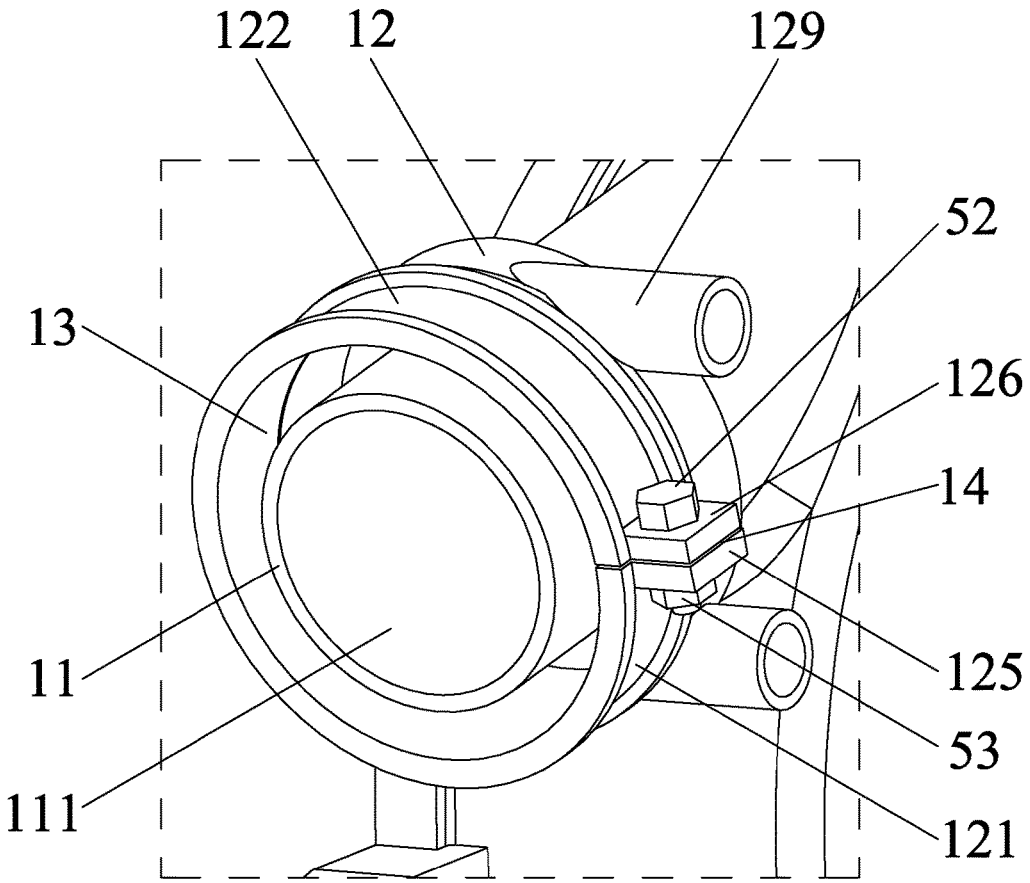
FIG. 11 is an enlarged view of part D in FIG. 10.
Figure 12:
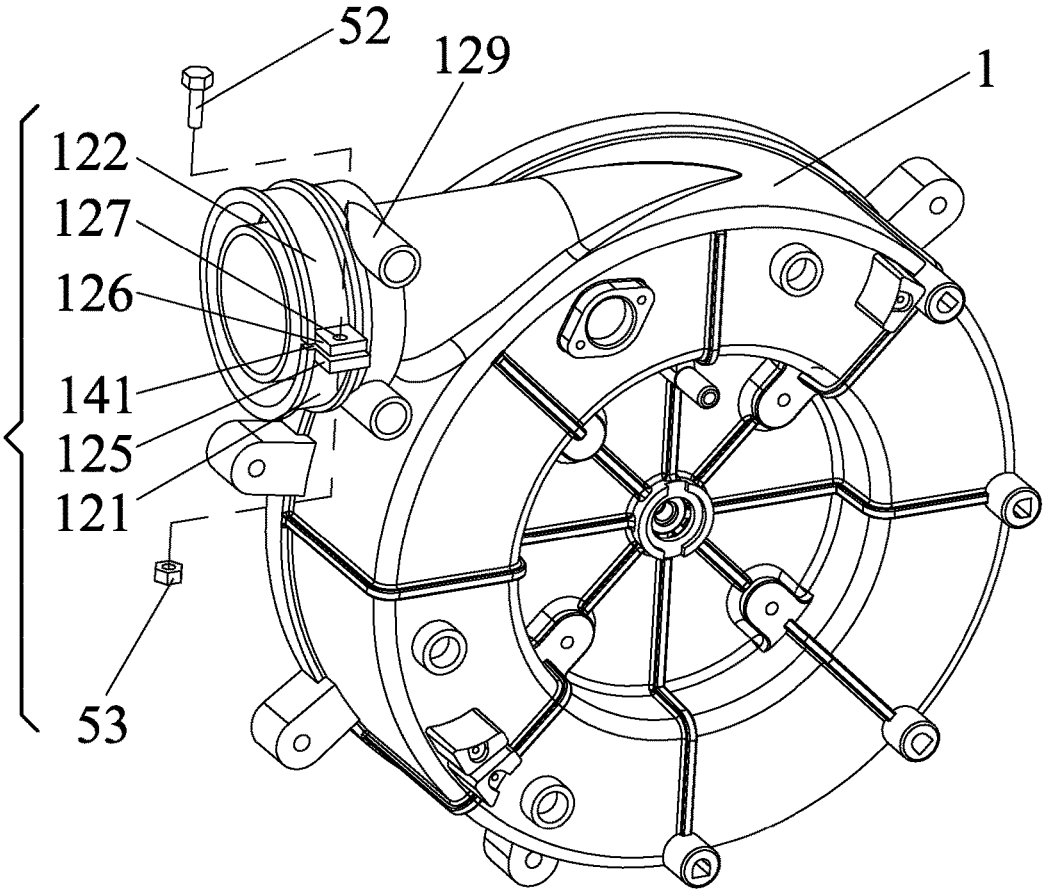
FIG. 12 is an exploded view of an induced draft fan in accordance with another embodiment of the present disclosure.
Figure 13:
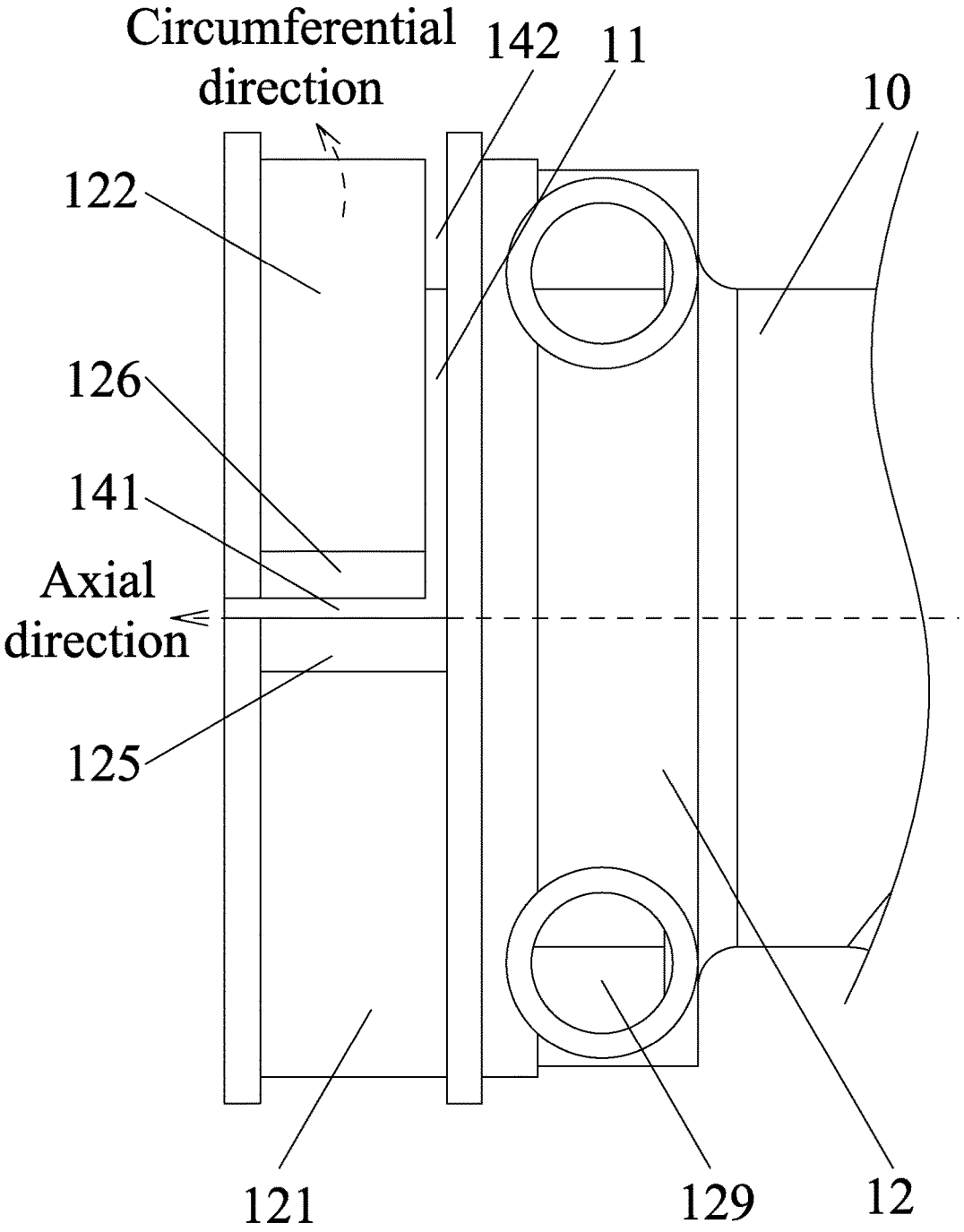
FIG. 13 is a front view of an air discharging pipe of an induced draft fan in accordance with another embodiment of the present disclosure.

As shown in FIGS. 7-9, a gas furnace comprises an induced draft fan in Example 1 and a conversion interface 2 which is disposed on the air discharge pipe of the induced draft fan. The conversion interface 2 is embedded in the annular groove 13, a seal ring 3 is disposed between the conversion interface 2 and the outer pipe 12; the curved groove 14 is located outside the seal ring 3, a hose clamp 51 is disposed in the locating slot 15, the body of the hose clamp 51 is located on the flexible part 122 and the fixed part 121 to close up the curved groove.

When the conversion interface 2 is embedded in the annular groove 13, a discharge chamber 131 is formed between the inner wall of the conversion interface 2 and the inner pipe 11. The discharge chamber 131 communicates with the air discharge passage 111. The drain hole 128 communicates with the discharge chamber 131. During work, the rotation of the wind wheel 4 of the induced draft fan produces air flow, the air flows from the inner chamber 19, the air discharge passage 111, to the conversion interface 2. The water vapor in the water flow gradually cools to form condensate water, the condensate water flows from the discharge chamber 131 into the drain hole 128, and then is drained out of the induced draft fan via the drain pipe 129.

Example 3

FIGS. 10-13 show another induced draft fan which is different from that in Example 1 in that:

The curved groove 14 is L-shaped and comprises an axial part 141 and a circumferential part 142; the fixed part 121 comprises a lower lug 125 in the vicinity of the axial part 141, and the flexible part 122 comprises an upper lug 126 in the vicinity of the axial part 141 and corresponding to the lower lug 125; the upper lug 126 and the lower lug 125 each comprise mounting through holes 127, each mounting through hole 127 comprises a bolt 52, and a nut 53 is provided at a tail of the bolt 52, and the bolt 52 and the nut 53 cooperate to lock the fixed part 121 and the flexible part 122.

In this example, the lower lug and the upper lug are locked by the bolt and the nut, thus simplifying the structure, facilitating the assembly, and reducing the costs.

Example 4

Figure 14:
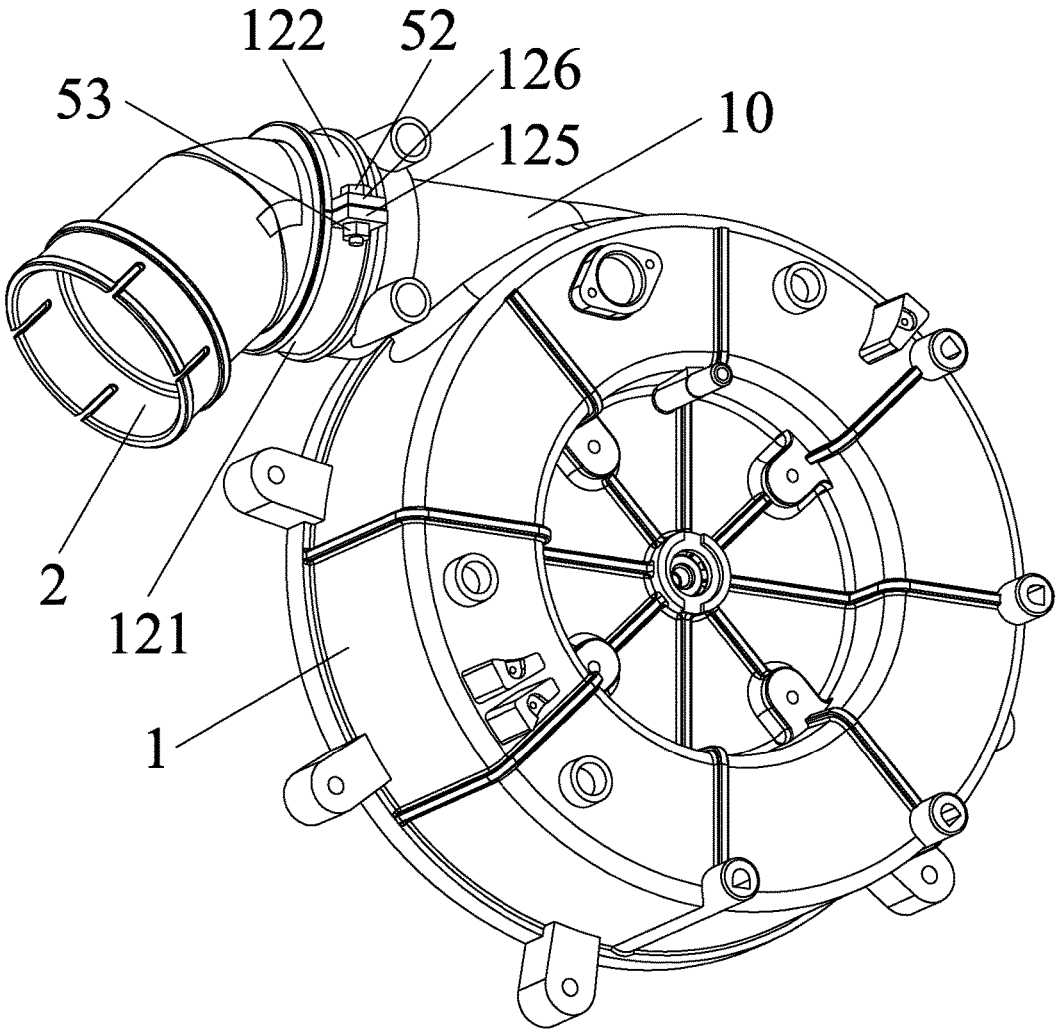
FIG. 14 is a schematic diagram of a gas furnace comprising an induced draft fan and a conversion interface in accordance with another embodiment of the present disclosure.

FIG. 14 provides another gas furnace which is different from that in Example 2 in that:

The induced draft fan in Example 3 is employed, the bolt 52 and the nut 53 cooperate to lock the fixed part 121 and the flexible part 122, and close up the axial part 141, thus simplifying the structure, and reducing the costs.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An induced draft fan, comprising:

a volute comprising a chamber and an air discharge pipe; and a wind wheel disposed in the chamber of the volute;

wherein the wind wheel is connected to a rotation shaft of a motor;

the air discharge pipe is disposed on one side of the volute, and comprises an inner pipe and an outer pipe surrounding the inner pipe;

the inner pipe of the air discharge pipe communicates with the chamber to form an air discharge passage;

an annular groove is disposed between the inner pipe and the outer pipe; and an outer end of the outer pipe is provided with a curved groove, the curved groove extends axially and circumferentially to divide the outer pipe into a fixed part and a flexible part.

2. The induced draft fan of claim 1, wherein a first flange and a second flange protrude circumferentially from the outer end of the outer pipe, the first flange is located on an end face of the outer pipe, a locating slot is disposed between the first flange and the second flange, and the curved groove is located in the locating slot.

3. The induced draft fan of claim 2, wherein the curved groove is arc-shaped or L-shaped.

4. The induced draft fan of claim 3, wherein the curved groove is L-shaped and comprises an axial part and a circumferential part, and the circumferential part is close to one side of the second flange.

5. The induced draft fan of claim 4, wherein the outer pipe comprises at least one drain hole at a bottom of the annular groove, and a drain pipe communicates with the at least one drain hole.

6. The induced draft fan of claim 5, wherein the outer pipe comprises two drain holes, and the drain pipe is tangent to the outer pipe.

7. The induced draft fan of claim 6, wherein a central angle formed by the axial part and the circumferential part of the curved groove is greater than or equal to 90 degrees and less than or equal to 270 degrees.

8. The induced draft fan of claim 1, wherein the curved groove is L-shaped and comprises an axial part and a circumferential part; the fixed part comprises a lower lug in the vicinity of the axial part, and the flexible part comprises an upper lug in the vicinity of the axial part and corresponding to the lower lug; the upper lug and the lower lug each comprise mounting through holes, each mounting through hole comprises a bolt, and a nut is provided at a tail of the bolt, and the bolt and the nut cooperate to lock the fixed part and the flexible part.

9. The induced draft fan of claim 8, wherein the outer pipe comprises at least one drain hole at a bottom of the annular groove, and a drain pipe communicates with the at least one drain hole.

10. The induced draft fan of claim 9, wherein the outer pipe comprises two drain holes, and the drain pipe is tangent to the outer pipe.

11. The induced draft fan of claim 10, wherein a central angle formed by the axial part and the circumferential part of the curved groove is greater than or equal to 90 degrees and less than or equal to 270 degrees.

12. The induced draft fan of claim 1, wherein the outer pipe comprises at least one drain hole at a bottom of the annular groove, and a drain pipe communicates with the at least one drain hole.

13. The induced draft fan of claim 12, wherein the outer pipe comprises two drain holes, and the drain pipe is tangent to the outer pipe.

14. The induced draft fan of claim 13, wherein a central angle formed by the axial part and the circumferential part of the curved groove is greater than or equal to 90 degrees and less than or equal to 270 degrees.

15. A gas furnace, comprising an induced draft fan of claim 1 and a conversion interface which is disposed on the air discharge pipe of the induced draft fan, wherein the conversion interface is embedded in the annular groove, a seal ring is disposed between the conversion interface and the outer pipe; the curved groove is located outside the seal ring, a hose clamp is disposed in the locating slot, a body of the hose clamp is located on the flexible part and the fixed part to close up the curved groove.

16. The furnace of claim 15, wherein a first flange and a second flange protrude circumferentially from the outer end of the outer pipe, the first flange is located on an end face of the outer pipe, a locating slot is disposed between the first flange and the second flange, and the curved groove is located in the locating slot.

17. The furnace of claim 16, wherein the curved groove is L-shaped and comprises an axial part and a circumferential part, and the circumferential part is close to one side of the second flange.

18. A gas furnace, comprising an induced draft fan of claim 1 and a conversion interface which is disposed on the air discharge pipe of the induced draft fan, wherein the conversion interface is embedded in the annular groove, a seal ring is disposed between the conversion interface and the outer pipe; the curved groove is located outside the seal ring, and the bolt and the nut cooperate to lock the fixed part and the flexible part, and close up the axial part.

19. The furnace of claim 18, wherein the curved groove is L-shaped and comprises an axial part and a circumferential part; the fixed part comprises a lower lug in the vicinity of the axial part, and the flexible part comprises an upper lug in the vicinity of the axial part and corresponding to the lower lug; the upper lug and the lower lug each comprise mounting through holes, each mounting through hole comprises a bolt, and a nut is provided at a tail of the bolt, and the bolt and the nut cooperate to lock the fixed part and the flexible part.

20. The furnace of claim 19, wherein a central angle formed by the axial part and the circumferential part of the curved groove is greater than or equal to 90 degrees and less than or equal to 270 degrees.

* * * * *